US006962306B2

(12) United States Patent
West

(10) Patent No.: US 6,962,306 B2
(45) Date of Patent: Nov. 8, 2005

(54) UNITS FOR STORING FLEXIBLE ELONGATED OBJECTS

(76) Inventor: Ronald R. West, 671 E. Country Meadow La., Alpine, UT (US) 84004

( * ) Notice: Subject to any disclaimer, the term of this patent is extended or adjusted under 35 U.S.C. 154(b) by 0 days.

(21) Appl. No.: 10/619,817

(22) Filed: Jul. 14, 2003

(65) Prior Publication Data

US 2004/0007640 A1 Jan. 15, 2004

Related U.S. Application Data

(60) Provisional application No. 60/395,776, filed on Jul. 15, 2002.

(51) Int. Cl.[7] ..... B65H 75/38

(52) U.S. Cl. ..... 242/405.2

(58) Field of Search ..... 242/388.6, 401, 242/402, 405.1, 405.2

(56) References Cited

U.S. PATENT DOCUMENTS 4,177,961 A * 12/1979 Gruenewald ..... 242/405.2
4,778,125 A * 10/1988 Hu ..... 242/405.2
6,142,405 A 11/2000 Black
6,286,777 B1 9/2001 Black

* cited by examiner

*Primary Examiner*—William A. Rivera
(74) *Attorney, Agent, or Firm*—Starkweather & Associates; Michael W. Starkweather; Jason P. Webb

(57) ABSTRACT

Units for storing flexible elongated objects are disclosed. In an exemplary embodiment, the storage unit includes a left end portion and a right end portion. An upper left recess and a lower left recess are disposed in the left end portion. The upper left recess is located between a left upper post and a left center post, and the lower left recess is located between the left center post and a left lower post. An upper right recess and a lower right recess are disposed in the right end portion. The upper right recess is located between a right upper post and a right center post, and the lower right recess is located between the right center post and a right lower post. The upper left recess is substantially aligned with the upper right recess, and the lower left recess is substantially aligned with the lower right recess.

20 Claims, 11 Drawing Sheets

UNITS FOR STORING FLEXIBLE ELONGATED OBJECTS

RELATED APPLICATIONS

This application is related to and claims priority from U.S. Provisional Patent Application Ser. No. 60/395,776 filed Jul. 15, 2002, for "Cord Storage Device," with inventor Ronald R. West, which is incorporated herein by reference.

TECHNICAL FIELD

The present invention relates generally to flexible elongated objects, such as cords, ropes, strings, twine, cables, hoses, and the like. More specifically, the present invention relates to units that may be used to store such objects.

BACKGROUND

Many different types of cords, ropes, strings, twine, cables, hoses, electrical wire, and other flexible elongated objects are commonly used in both home and commercial settings. For example, electrical extension cords are commonly used to lengthen the cord of an electrical device so that the device can be connected to a remote power supply or receptacle. Ropes, string, and twine are commonly used to bind different types of objects together. Hoses are commonly used to supply different types of fluids to a wide variety of locations, such as lawn within an individual's yard. Electrical wire is often used to facilitate electronic communication between different types of electronic devices. These are just a few examples of the many different ways in which people may use flexible elongated objects in everyday life.

Despite the benefits they provide, flexible elongated objects can be difficult to store. One reason for this difficulty is that flexible elongated objects are often quite long. For example, electrical extension cords are often dozens, and sometimes even hundreds, of feet long. Because of their length, many people choose to wrap or wind their flexible elongated objects into a more compact shape, like a circular or semi-circular shape, before storing them. Many people simply wind the flexible elongated objects around their arms or hands. However, such an approach may become unwieldy for flexible elongated objects that are particularly heavy, long, thick, etc.

Moreover, once the flexible elongated objects have been wound into a more convenient shape, they may easily become unwound from that shape. For example, some flexible elongated objects may have a natural tendency to move out of a wound position. This may be the case with relatively thick objects, such as garden hoses or heavy duty extension cords.

In addition, it is easy for flexible elongated objects to become tangled. Sometimes tangling occurs as the objects are being wound, particularly if a person is simply winding an object around his or her arm. In other cases, the objects may become tangled as they are being stored. This frequently occurs, for example, when such objects are simply laid upon a floor, or even when they are stored on a nail, bracket, or the like that is attached to a wall. When flexible elongated objects become tangled, it is often difficult to use the objects without the burden of untangling them.

In view of the above, it would be an advancement in the art if improved units were provided for storing flexible elongated objects.

SUMMARY OF THE INVENTION

Various units for storing flexible elongated objects are disclosed. One embodiment of a storage unit disclosed herein includes a first winding region and a second winding region. A post is located between the first winding region and the second winding region. The storage unit has a storage unit length, the first winding region has a first winding region length, and the second winding region has a second winding region length. The first winding region length and the second winding region length are both parallel to the storage unit length.

The length of the first winding region may be substantially equal to the length of the second winding region. However, different winding regions on the same storage unit may have different lengths and/or different widths.

The storage unit may include one or more slots. The slots may be tapered, and they may include a plurality of nubs. Alternatively, or in addition, the slots may be configured to flex. In some embodiments, at least two of the plurality of nubs are sharply tapered so as to form a long, narrow region.

Embodiments of the storage unit may include one or more handles. For example, the storage unit may include an inner handle. A portion of the inner handle may be located within one or more of the winding regions in the storage unit. The inner handle may include a plurality of ribs. The storage unit may also include an outer handle. A portion of the outer handle may be located completely outside the first winding region and the second winding region. The outer handle may be removable.

In an alternative embodiment, the storage unit includes a left end portion and a right end portion. An upper left recess and a lower left recess are disposed in the left end portion. The upper left recess is located between a left upper post and a left center post, and the lower left recess is located between the left center post and a left lower post. An upper right recess and a lower right recess are disposed in the right end portion. The upper right recess is located between a right upper post and a right center post, and the lower right recess is located between the right center post and a right lower post. The upper left recess is substantially aligned with the upper right recess, and the lower left recess is substantially aligned with the lower right recess.

BRIEF DESCRIPTION OF THE DRAWINGS

The present embodiments will become more fully apparent from the following description and appended claims, taken in conjunction with the accompanying drawings. Understanding that these drawings depict only typical embodiments and are, therefore, not to be considered limiting of the invention's scope, the embodiments will be described with additional specificity and detail through use of the accompanying drawings in which:

DETAILED DESCRIPTION

It will be readily understood that the components of the present invention, as generally described and illustrated in the Figures herein, could be arranged and designed in a wide variety of different configurations. Thus, the following more detailed description of several exemplary embodiments of the present invention, as represented in the Figures, is not intended to limit the scope of the invention, as claimed, but is merely representative of the embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Figure 1:
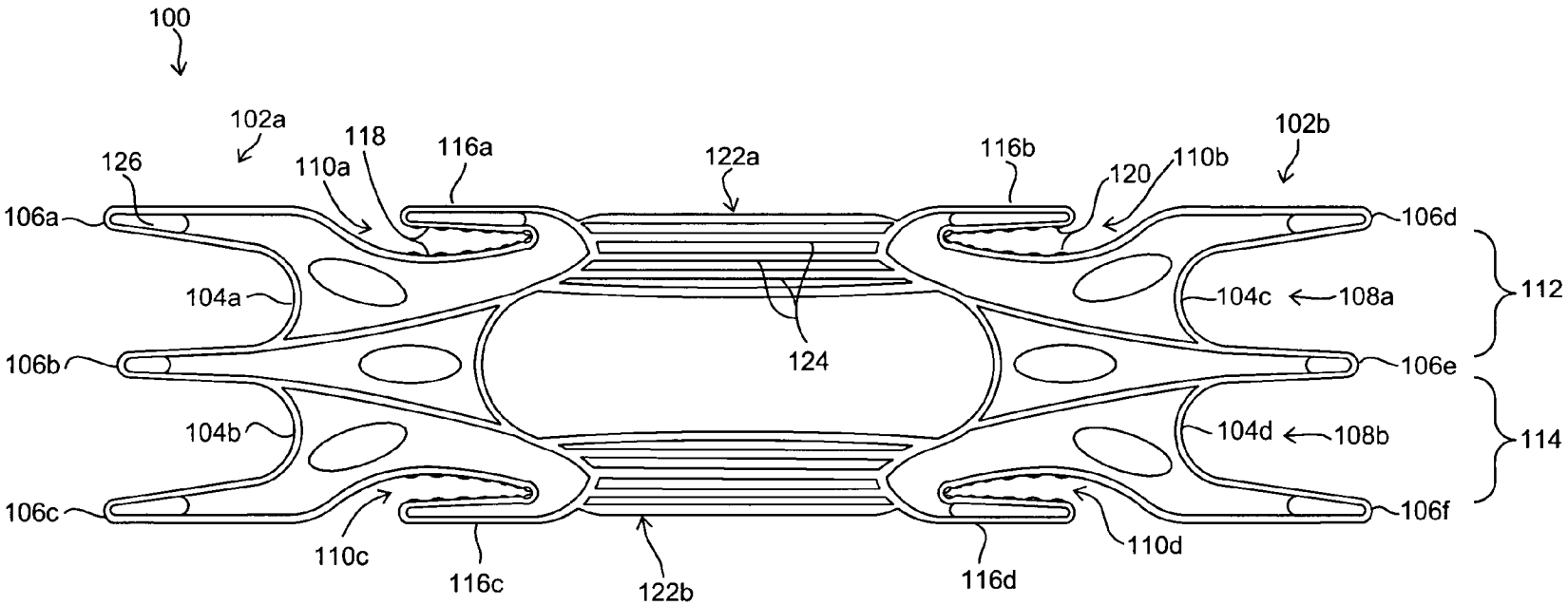
FIG. 1 is a front plan view of an embodiment of a unit for storing flexible elongated objects.

FIG. 1 is a front plan view of an embodiment of a unit 100 for storing flexible elongated objects, such as cords, ropes, strings, twine, cables, hoses, and the like. The storage unit 100 includes two end portions 102, namely a left end portion 102*a* and a right end portion 102*b*. Each end portion 102 includes a pair of recesses 104. More specifically, the left end portion 102*a* includes a left upper recess 104*a* and an left lower recess 104*b*. The right end portion 102*b* includes a right upper recess 104*c* and a right lower recess 104*d*. The left upper recess 104*a* is substantially aligned with the right upper recess 104*c*. The left lower recess 104*b* is substantially aligned with the right lower recess 104*d*.

Each recess 104 is located between two posts 106. More specifically, the left upper recess 104*a* is located between a left upper post 106*a* and a left center post 106*b*. The left lower recess 104*b* is located between the left center post 106*b* and a left lower post 106*c*. The right upper recess 104*c* is located between a right upper post 106*d* and a right center post 106*e*. The right lower recess 104*d* is located between the right center post 106*e* and a right lower post 106*f*. The left upper post 106*a* is substantially aligned with the right upper post 106*d*, the left center post 106*b* is substantially aligned with the right center post 106*e*, and the left lower post 106*c* is substantially aligned with the right lower post 106*f*.

The region between two recesses 104 that are aligned with one another will be referred to herein as a winding region 108. There are two distinct winding regions 108 in the storage unit 100 shown in FIG. 1, namely an upper winding region 108*a* and a lower winding region 108*b*. The different winding regions 108 are separated by the center posts 106*b*, 106*e*. One or more flexible elongated objects may be wound around the winding regions 108, as will be explained in greater detail below.

When a flexible elongated object is wound around one or more of the winding regions 108 of the storage unit 100, it is typically desirable to have some mechanism for preventing the object from becoming unwound. The storage unit 100 shown in FIG. 1 includes a plurality of slots 110 that perform this function.

Two slots 110 are located in an upper portion 112 of the storage unit 100, namely an upper left slot 110*a* and an upper right slot 110*b*. Similarly, two slots 110 are located in a lower portion 114 of the storage unit 100, namely a lower left slot 110*c* and a lower right slot 110*d*. Each slot 110 is bordered on one side by a finger 116. More specifically, the upper left slot 110*a* is bordered on one side by an upper left finger 116*a*. The upper right slot 110*b* is bordered on one side by an upper right finger 116*b*. The lower left slot 110*c* is bordered on one side by a lower left finger 116*c*. The lower right slot 110*d* is bordered on one side by a lower right finger 116*d*.

Each slot 110 includes two walls 118 that face each other. A plurality of nubs 120 are located on both of the walls 118 within each slot 110. The nubs 120 on the different walls 118 are substantially aligned with one another. When a portion of a flexible elongated object is inserted into the slot 110, the nubs 120 help to retain the object in place. Advantageously, the storage unit 100 shown in FIG. 1 includes differently sized nubs 120. More specifically, the nubs 120 near the shallow portion of the slot 110 are larger than the nubs 120 that are located farther inside the slot 110. Thus, the storage unit 100 can accommodate differently sized flexible elongated objects.

The shape of the slots 110 also helps to retain the flexible elongated objects in place. As shown in FIG. 1, the slots 110 are tapered. That is, the distance between the facing walls 118 within each slot 110 is larger in the shallow portion of the slot 110 than it is farther inside the slot 110. For most types of flexible elongated objects, the distance between the facing walls 118 is substantially equal to the diameter of the flexible elongated object at some point within the slot 110. This point will be close to the shallow portion of the slot 110 for thicker objects, and farther inside the slot 110 for thinner objects. Moving a flexible elongated object past this point in the slot 110 causes the corresponding finger 116 to flex, or in other words, to be pushed in an outward direction. In embodiments where the storage unit 100 is made of a flexible, resilient material, the finger 116, when flexed, exerts a spring force against the portion of the flexible elongated object that is inside the slot 110, thereby restricting movement of that portion of the object out of the slot 110.

The storage unit 100 also includes a pair of handles 122. More specifically, an upper handle 122*a* is located between the upper left slot 110*a* and the upper right slot 110*b*. A lower handle 122*b* is located between the lower left slot 110*c* and the lower right slot 110*d*. Both of the handles 122 include ribs 124. The ribs 124 allow a user to more securely grip the storage unit 100. Of course, in alternative embodiments one or both of the handles 122 may be smooth. Marketing and/or advertising information, such as a logo or brand name, may be included on at least one of the handles 122, particularly handles 122 that are smooth.

Advantageously, both of the handles 122 are located close to a winding region 108 on the storage unit 100. In fact, in the embodiment shown in FIG. 1, a portion of the upper handle 122*a* is located within the upper winding region 108*a*, and a portion of the lower handle 122*b* is located within the lower winding region 108*b*. Therefore, flexible elongated objects may be wrapped close to the area where the storage unit 100 is held by a user, thereby reducing the stress on a user's hand and wrist as the object is being wound.

In typical operation, a user of the storage unit 100 grasps one of the handles 122 with one hand, and wraps a flexible elongated object around one or more of the winding regions 108 with the other hand. More specifically, a first end of the flexible elongated object is generally inserted into one of the slots 110, which retains that end in place. The object is then wound around one or more of the winding regions 108. When substantially all of the object has been wound, the second end of the object is inserted into another slot 110 on the storage unit 100.

The embodiment of the storage unit 100 shown in FIG. 1 has a generally elongated shape. The winding regions 108 are also elongated. The length of the winding regions 108 is parallel to the length of the storage unit 100. Increasing the length of the winding regions 108 reduces the number of winds in the object to be stored (i.e., the number of times that the object is wound around the winding regions 108). This generally helps to prevent twists and tangles in the object.

The storage unit 100 is typically made from a flexible material, such as plastic. The embodiment shown in FIG. 1 may be formed using an injection molding technique. Alternative embodiments of the storage unit 100 may be formed using alternative techniques, such as blow molding.

The posts 106 at the end portions 102 of the storage unit 100 each include a hole 126. These holes 126 may be used to hang the storage unit 100 in a desired location, such as a garage wall. The holes may be configured so that the storage unit 100 may hang directly on a nail, bracket, or the like. Alternatively, a ring (not shown) may be placed inside one of the holes 126 and used to hang the storage unit 100.

In the embodiment of the storage unit 100 shown in FIG. 1, the winding regions 108 are substantially symmetrical, i.e., they have substantially the same length and substantially the same width. In alternative embodiments, different winding regions 108 on the same storage unit 100 may have different lengths and/or different widths.

Figure 2:
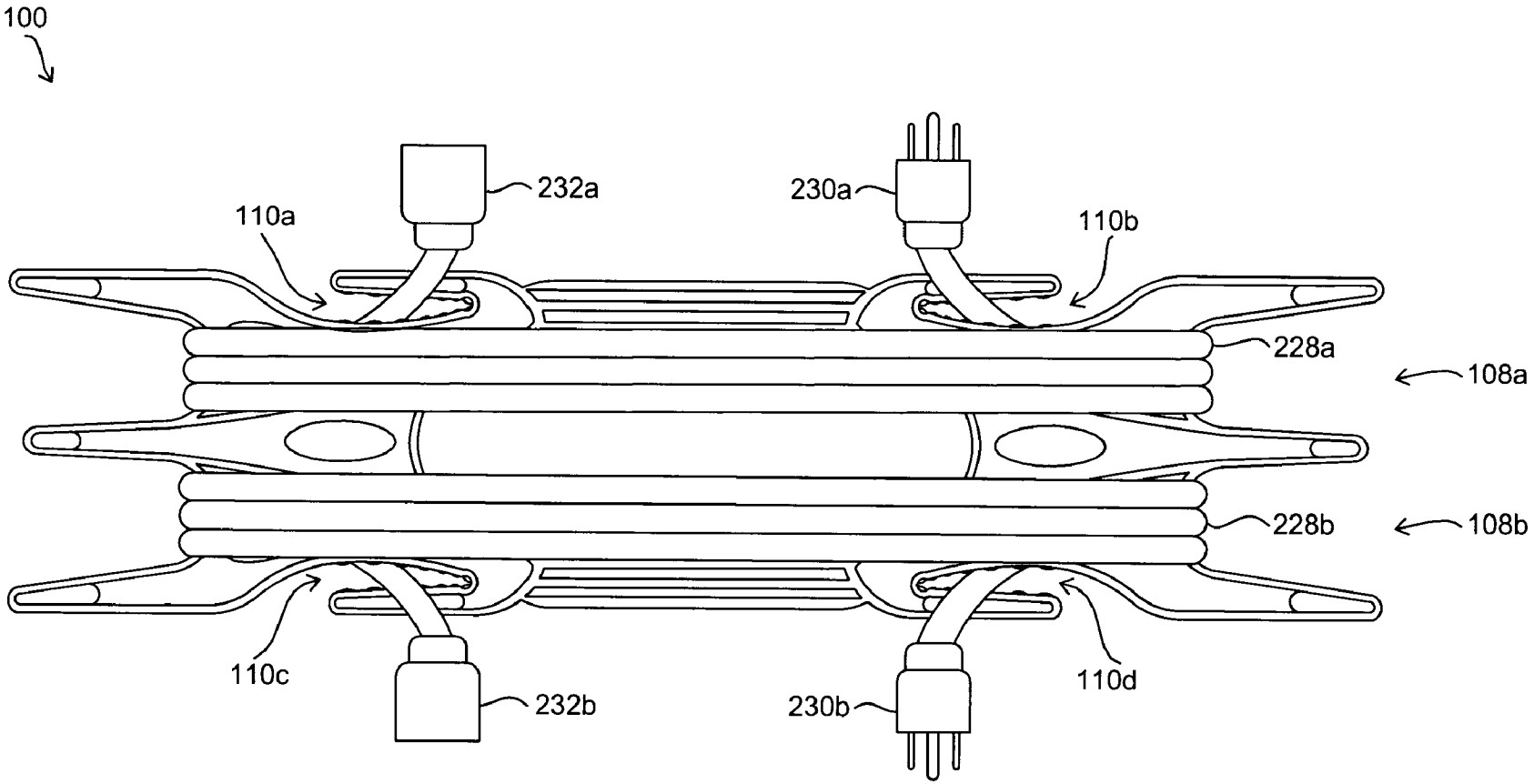
FIG. 2 is a front plan view of the storage unit of FIG. 1 holding two separate electrical extension cords.

FIG. 2 is a front plan view of the storage unit 100 of FIG. 1 holding two separate electrical extension cords 228, namely a first extension cord 228*a* and a second extension cord 228*b*. The extension cords 228 shown in FIG. 2 are exemplary only; those skilled in the art will recognize that the storage unit 100 may be used to hold any type of flexible elongated object 228. In some embodiments, different types of flexible elongated objects 228 may be stored on the same storage unit 100. For example, an electrical extension cord 228 may be stored on one of the winding regions 108, and some other type of flexible elongated object 228 (e.g., string, twine, etc.) may be stored on another winding region 108.

Both of the extension cords 228 shown in FIG. 2 include a plug 230 at one end and a socket 232 at the other end. More specifically, the first extension cord 228 includes a first plug 230*a* at one end and a first socket 232*a* at the other end. The second extension cord 228 includes a second plug 230*b* at one end and a second socket 232*b* at the other end. Each plug 230 is configured to mate with a socket located at an electrical outlet. Each socket 232 is configured to mate with a plug located on a cord that is connected to an electrical device.

The first extension cord 228 is wound around the upper winding region 108*a* of the storage unit 100. A portion of the first extension cord 228*a* near the first socket 232*a* is held in place within the upper left slot 110*a,* and another portion of the first extension cord 228*a* near the first plug 230*a* is held in place within the upper right slot 110*b*. The second extension cord 228*b* is wound around the lower winding region 108*b* of the storage unit 100. A portion of the second extension cord 228*b* near the second socket 232*b* is held in place within the lower left slot 110*c,* and another portion of the second extension cord 228*b* near the second plug 230*b* is held in place within the lower right slot 110*d*.

Figure 3:
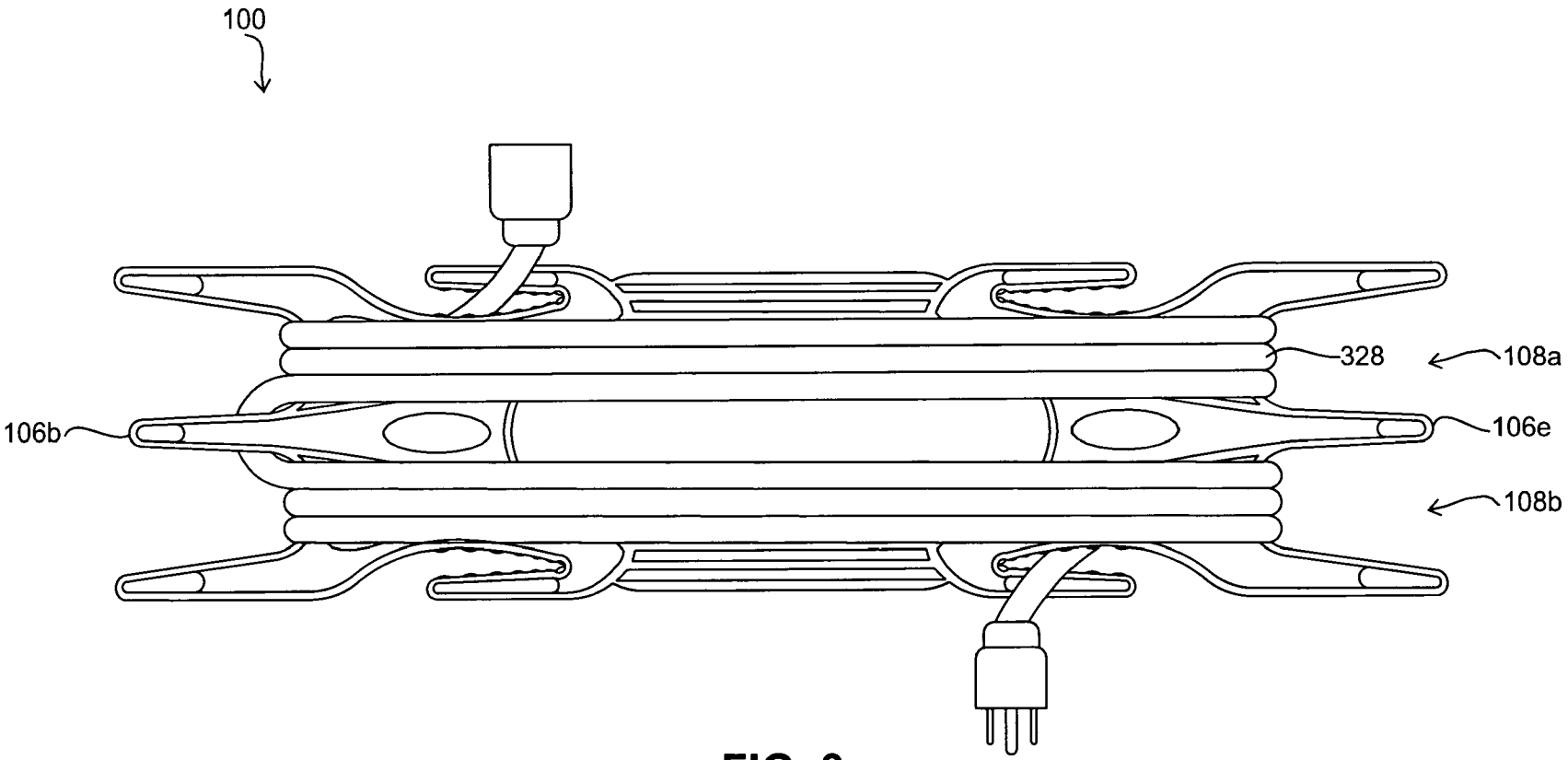
FIG. 3 is a front plan view of the storage unit of FIG. 1 holding a single electrical extension cord.

FIG. 3 is a front plan view of the storage unit 100 of FIG. 1 holding a single electrical extension cord 328. A first portion of the extension cord 328 is wound around the upper winding region 108*a*. A second portion of the extension cord 328 is wound around the lower winding region 108*b*.

Sometimes when a flexible elongated object 328 is being wound around one of the winding regions 108, the object 328 may become tangled. In those types of situations, one of the center posts 106*b,* 106*e* may be used to untangle the object 328. For example, suppose that an object 328 becomes tangled while it is being wound around the upper winding region 108*a*. As shown in FIG. 3, a user may wrap the object 328 around the left center post 106*b,* thereby reversing the direction in which winding occurs, and then wind the object 328 around the lower winding region 108*b*. Winding different portions of a flexible elongated object 328 in different directions around different winding regions 108 on the storage unit 100 generally helps to prevent or eliminate tangles in the object 328 that is being stored.

Figure 4:
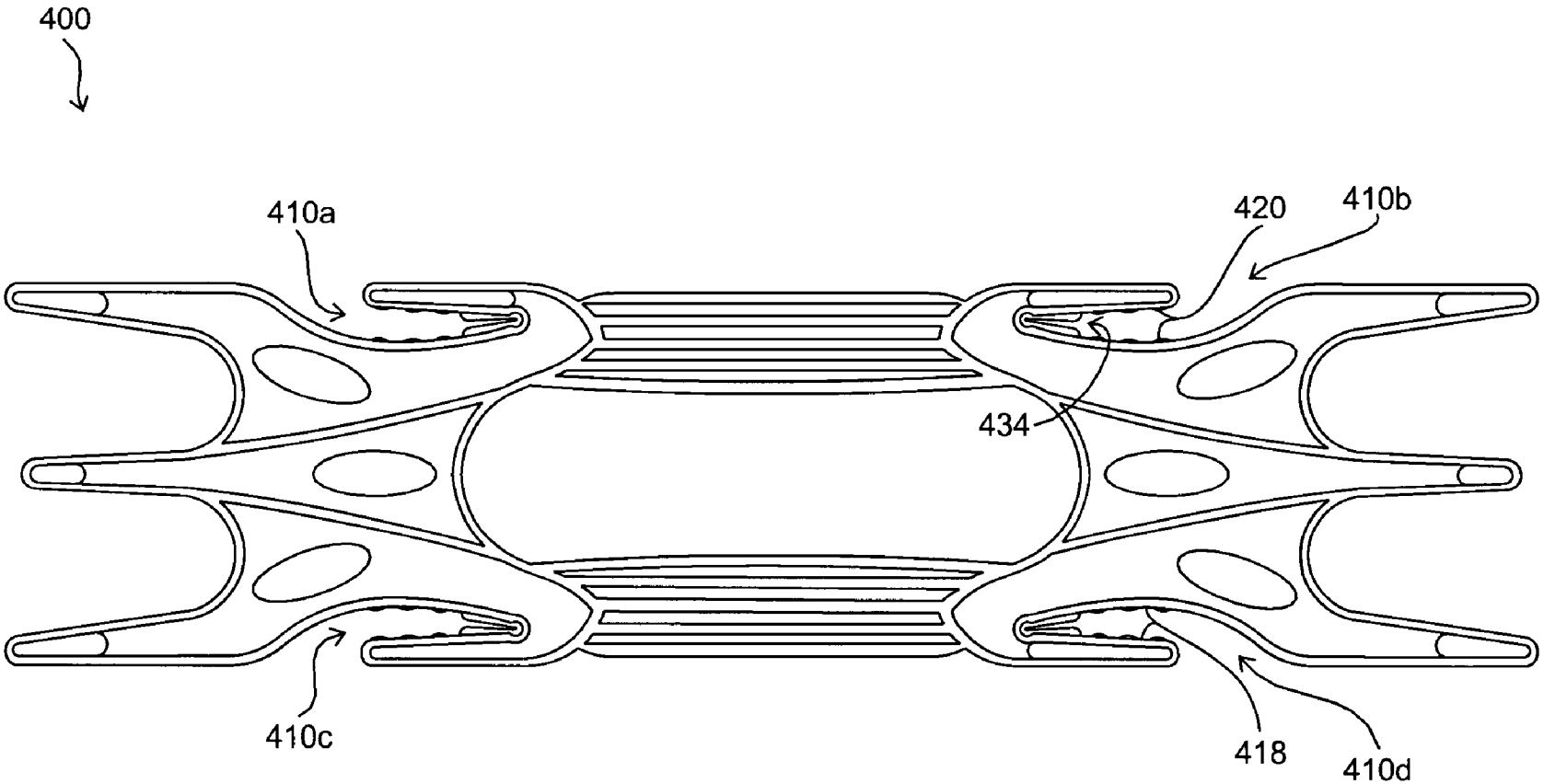
FIG. 4 is a front plan view of an alternative embodiment of a storage unit that is configured to store flexible elongated objects that are quite thin.

FIG. 4 is a front plan view of another alternative embodiment of a storage unit 400. The storage unit 400 shown in FIG. 4 is configured to store flexible elongated objects 228 that are quite thin, such as twine or string. As with previously described embodiments, a plurality of nubs 420 are located on both of the walls 418 within each slot 410. However, in the embodiment shown in FIG. 4, the nubs 420 in the deepest part of each of the slots 410 are more sharply tapered than the other nubs 420 so that a long, narrow region 434 is formed inside the slot 410. The long, narrow region 434 is generally configured to be narrower than the flexible elongated objects 228 that are to be stored therein. Therefore, when a flexible elongated object 228 is inserted into the long, narrow region 434, the nubs 420 exert a compressive force on the object 228, thereby holding the object 228 in place.

Figure 5:
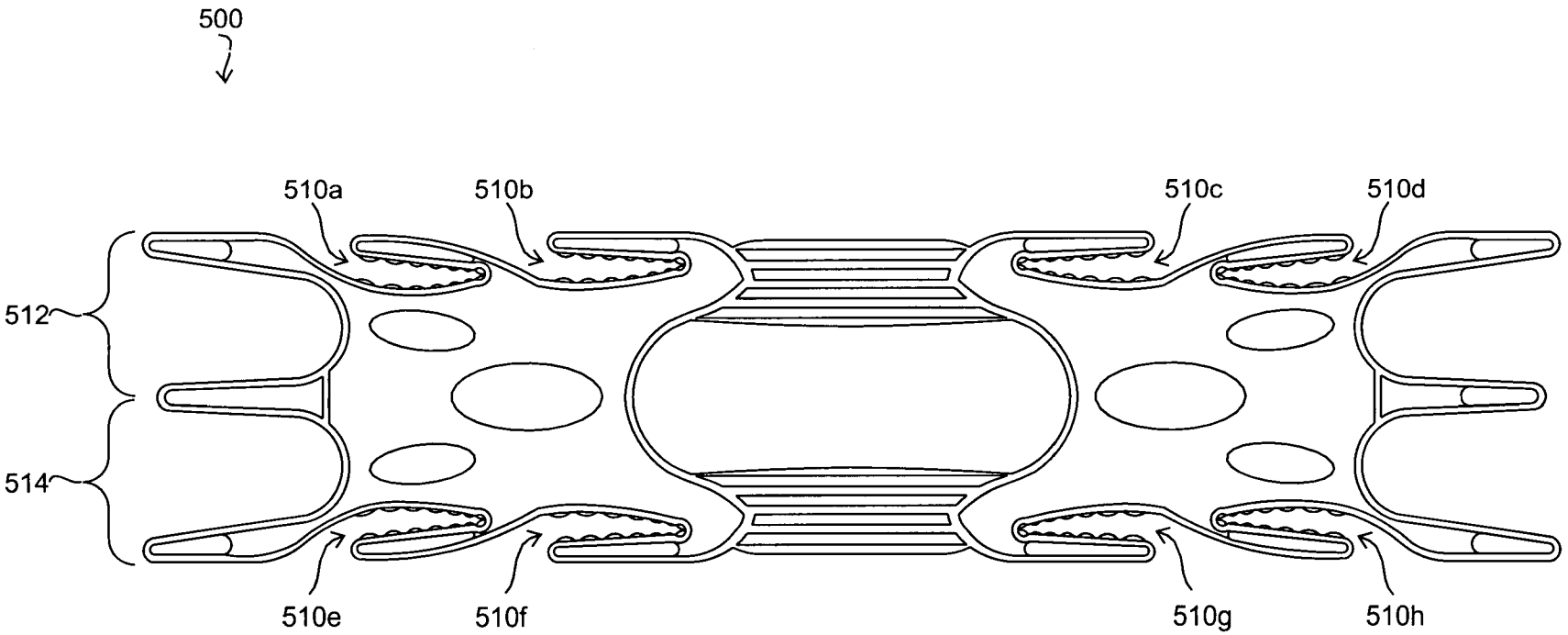
FIG. 5 is a front plan view of an alternative embodiment of a storage unit that includes additional slots.

FIG. 5 is a front plan view of another alternative embodiment of a storage unit 500. The storage unit 500 shown in FIG. 5 includes eight different slots 510*a–h,* four in the upper portion 512 of the storage unit 500, and four in the lower portion 514 of the storage unit 500. Increasing the number of slots 510 in the storage unit 500 provides additional locations where a flexible elongated object 228 may be secured in place. This may be advantageous so that a large portion of a flexible elongated object 228 is not left dangling in a loose position. Alternative embodiments of the storage unit 500 may include any number of slots 510.

Figure 6:
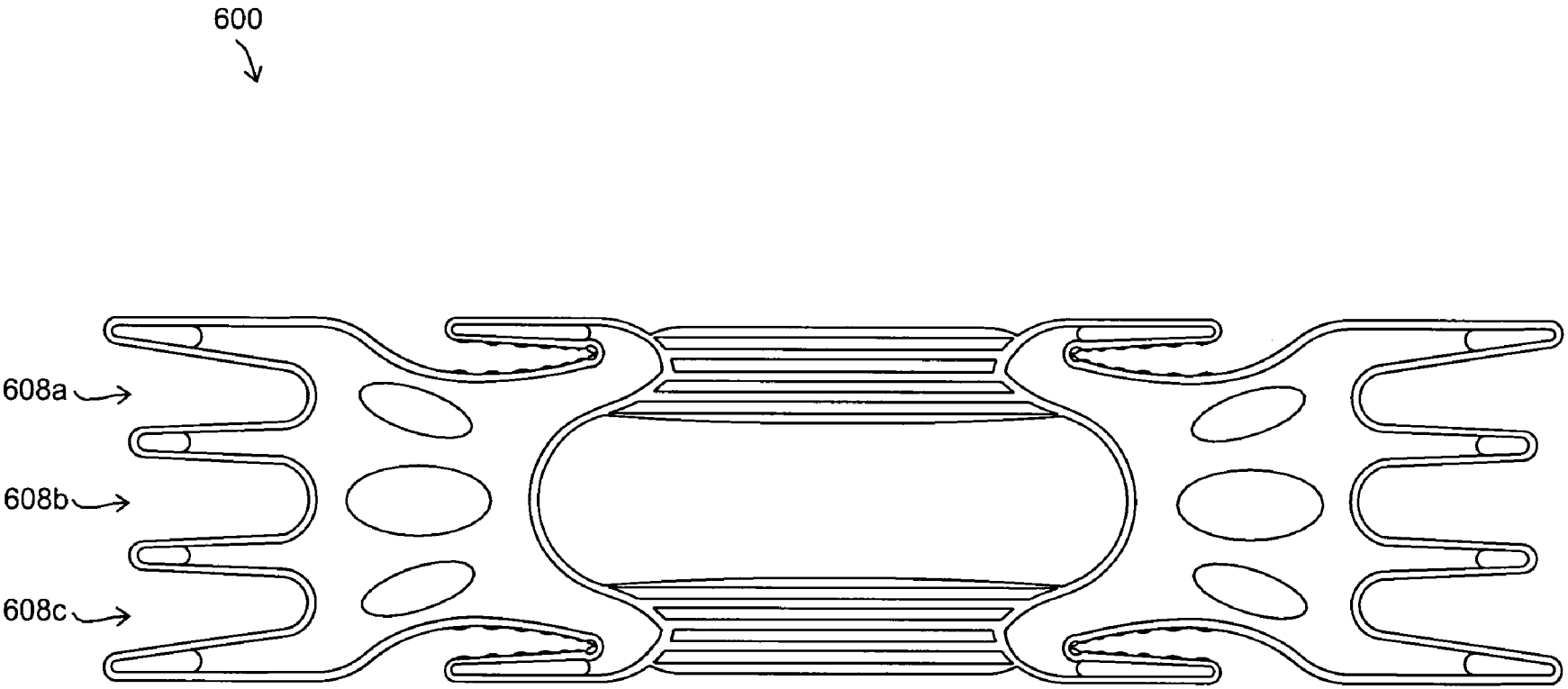
FIG. 6 is a front plan view of an alternative embodiment of an storage unit that includes additional winding regions.

FIG. 6 is a front plan view of another alternative embodiment of an storage unit 600. The storage unit 600 shown in FIG. 6 includes three different winding regions 608, an upper winding region 608*a,* an intermediate winding region 608*b,* and a lower winding region 608*c*. Thus, three different flexible elongated objects 228 may be stored on the storage unit 600 shown in FIG. 6, one on the upper winding region 608*a,* one on the intermediate winding region 608, and another on the lower winding region 608*b*. Of course, alternative embodiments of the storage unit 600 may include more than three winding regions 608.

There are a wide variety of situations in which a user may wish to store several different flexible elongated objects 228 on the same storage unit 600. For example, a user may wish to store several different sets of holiday lights on the same storage unit 600. In general, increasing the number of winding regions 608 in the storage unit 600 increases the number of flexible elongated objects 228 that may be stored on the storage unit 600. Alternative embodiments of the storage unit 600 may include more than three winding regions 608.

Figure 7:
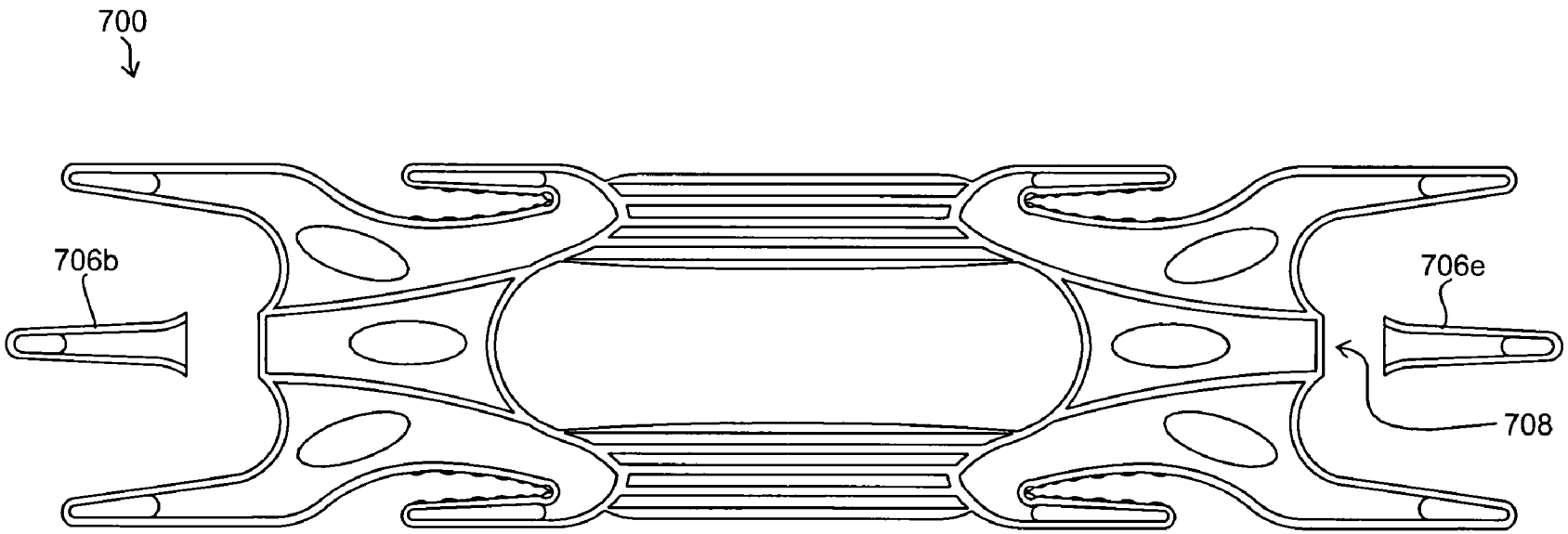
FIG. 7 is a front plan view of an alternative embodiment of a storage unit that includes removable center posts.

FIG. 7 is a front plan view of another alternative embodiment of a storage unit 700. In the storage unit 700 shown in FIG. 7, the left center post 706*b* and the right center post 706*e* are removable. Removing the center posts 706*b*, 706*e* changes the storage unit 700 from having two smaller winding regions 708 to having one larger winding region 708, so that a larger flexible elongated object 228 may be wrapped around the storage unit 700. Thus, the embodiment shown in FIG. 7 provides a user with the option of storing multiple, smaller flexible elongated objects 228, or a single, larger flexible elongated object 228. If the former option is desired, the center posts 706*b*, 706*e* may be retained. If the latter option is desired, the center posts 706*b*, 706*e* may be removed. In some embodiments, the storage unit 700 may be configured so that the center posts 706*b*, 706*e* are able to be reattached to the storage unit 700.

Figure 8:
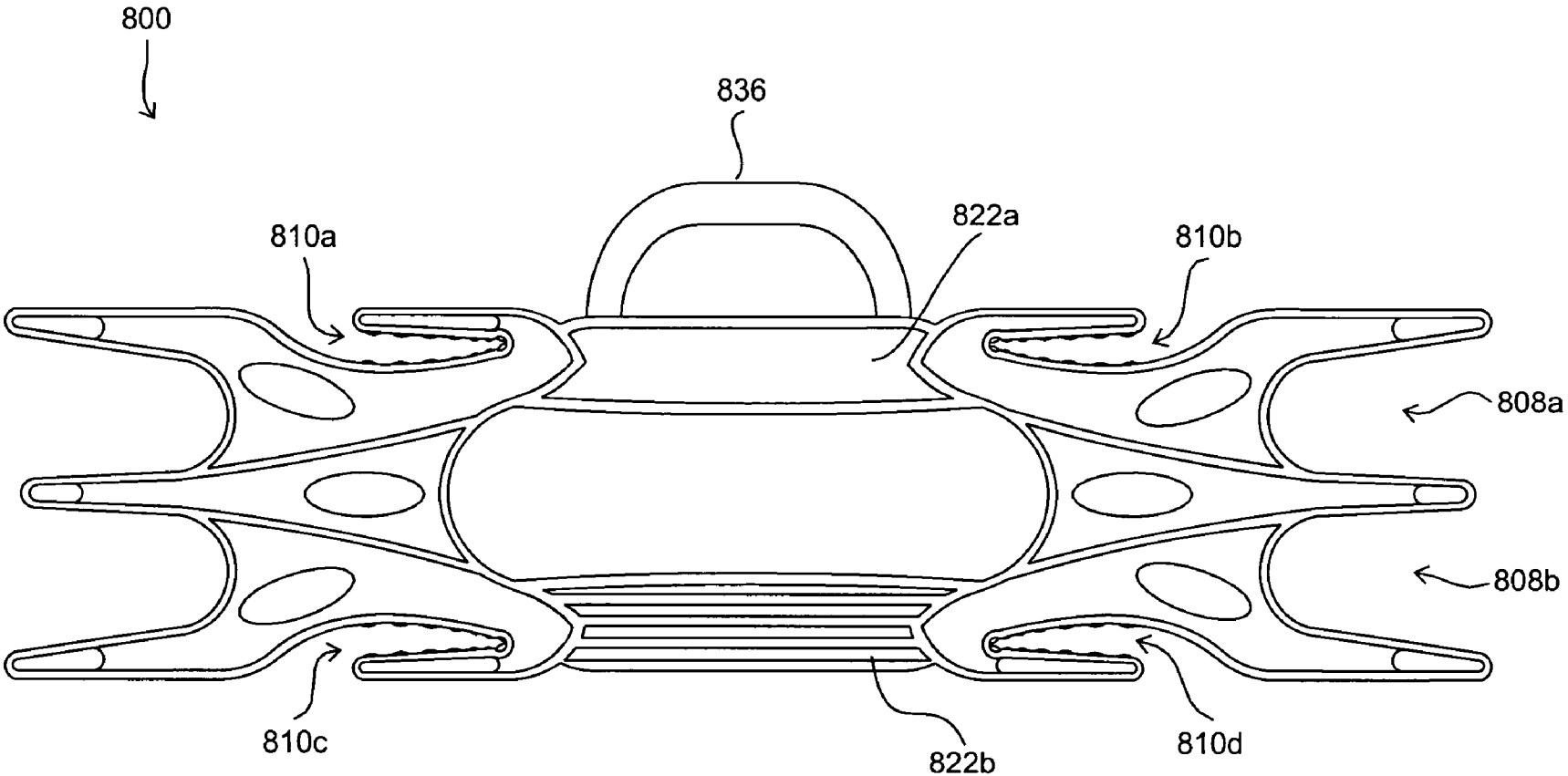
FIG. 8 is a front plan view of an alternative embodiment of a storage unit that includes an outer handle.

FIG. 8 is a front plan view of another alternative embodiment of a storage unit 800. The storage unit 800 includes a pair of inner handles 822. More specifically, an upper inner handle 822*a* is located between the upper left slot 810*a* and the upper right slot 810*b*. A lower handle 822*b* is located between the lower left slot 810*c* and the lower right slot 810*d*. A portion of the upper inner handle 822*a* is located within the upper winding region 808*a*, and a portion of the lower inner handle 822*b* is located within the lower winding region 808*b*.

The storage unit 800 also includes an outer handle 836. The portion of the outer handle 836 that is typically grasped by a user lies completely outside the winding regions 808 on the storage unit 800. An outer handle 836 may be advantageous in situations where it is difficult to adequately grasp either of the inner handles 822. For example, one or more flexible elongated objects 228 that are stored on the storage unit 800 may completely occupy the winding regions 808, making it difficult to fit one's hand around either of the inner handles 822. In such a situation, the storage unit 800 may be carried by the outer handle 836 instead of one of the inner handles 822. In some embodiments, the outer handle 836 may be configured to slide out from the storage unit 800.

Figure 9:
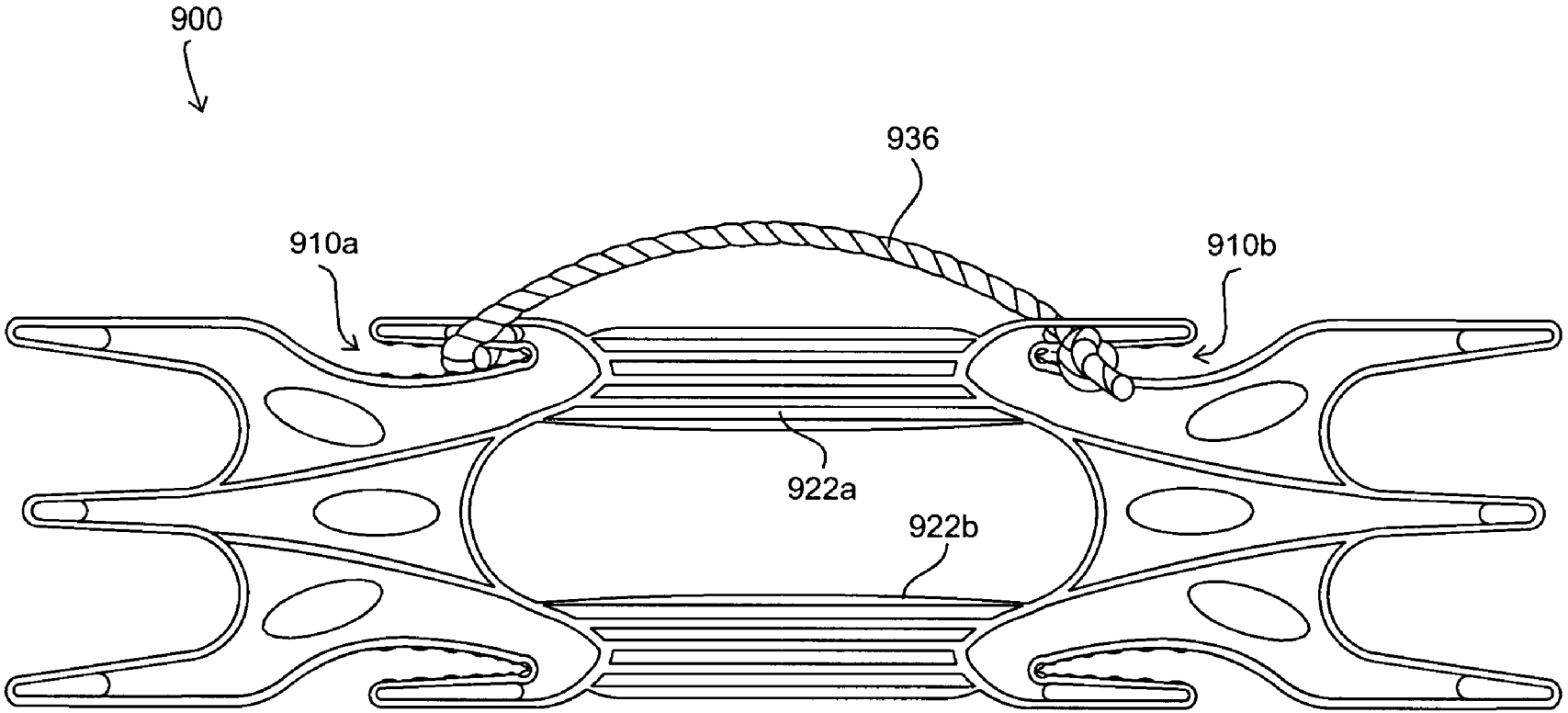
FIG. 9 is a front plan view of an alternative embodiment of a storage unit that includes a removable outer handle.

FIG. 9 is a front plan view of another alternative embodiment of a storage unit 900. The storage unit 900 shown in FIG. 9 also includes an outer handle 936 in addition to the inner handles 922. In the embodiment shown in FIG. 9, however, the outer handle 936 is removable.

The removable outer handle 936 shown in FIG. 9 is a piece of rope 936. One end of the rope 936 is inserted through the upper left slot 910*a*, and the other end of the rope 936 is inserted through the upper right slot 910*b*. Knots are tied at both ends of the rope 936. The removable handle 936 may be removed from the storage unit 100 by sliding one end of the rope 936 out of the upper left slot 910*a* and by sliding the other end of the rope 936 out of the upper right slot 910*b*.

Figure 10:
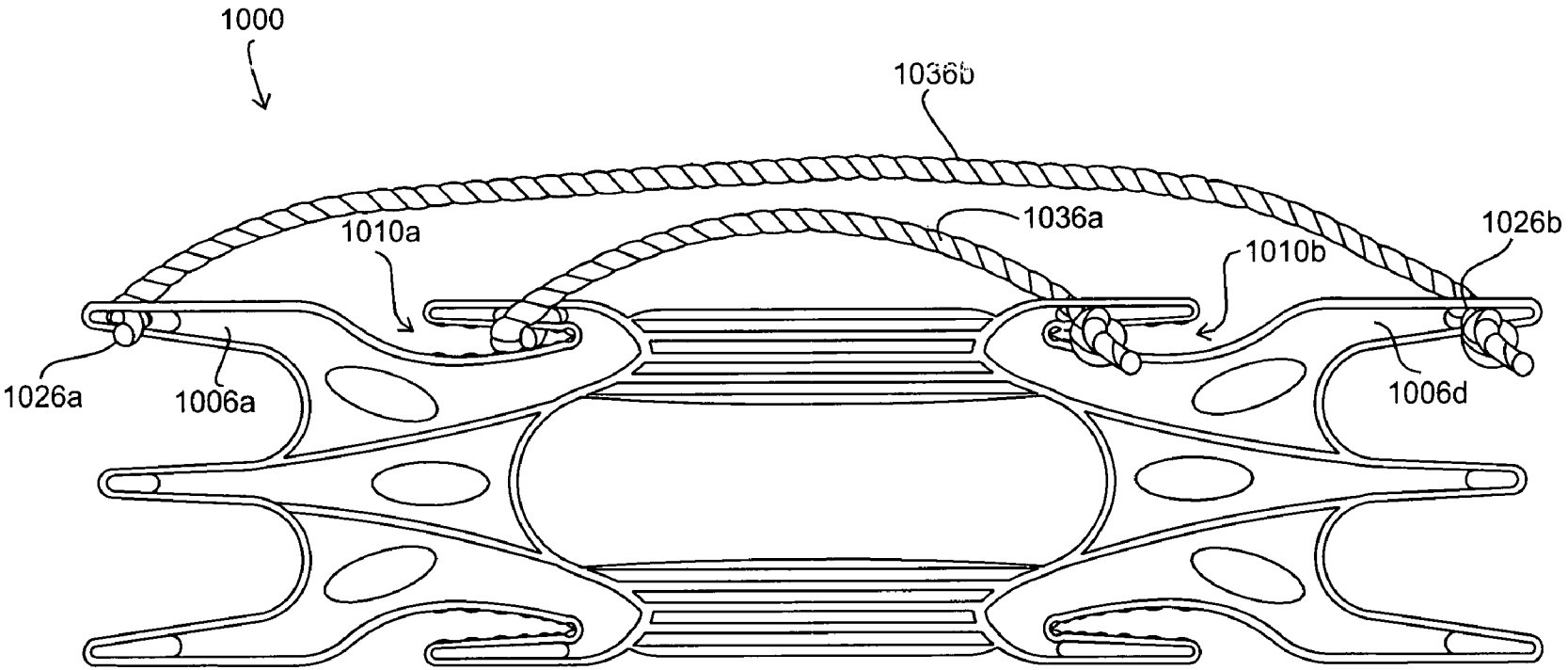
FIG. 10 is a front plan view of an alternative embodiment of a storage unit that includes two removable outer handles.

FIG. 10 is a front plan view of another alternative embodiment of a storage unit 1000. The storage unit 1000 shown in FIG. 10 includes two removable outer handles 1036. The removable outer handles 1036 are ropes 1036, and more specifically, a first rope 1036*a* and a second rope 1036*b*. One end of the first rope 1036*a* is inserted through the upper left slot 1010*a*, and the other end of the first rope 1036*a* is inserted through the upper right slot 1010*b*. One end of the second rope 1036*b* is inserted through a first hole 1026*a* in the left upper post 1006*a*, and the other end of the second rope 1036*b* is inserted through a second hole 1026*b* in the right upper post 1006*d*. Knots are tied at the ends of both the first rope 1036*a* and the second rope 1036*b*.

Figure 11:
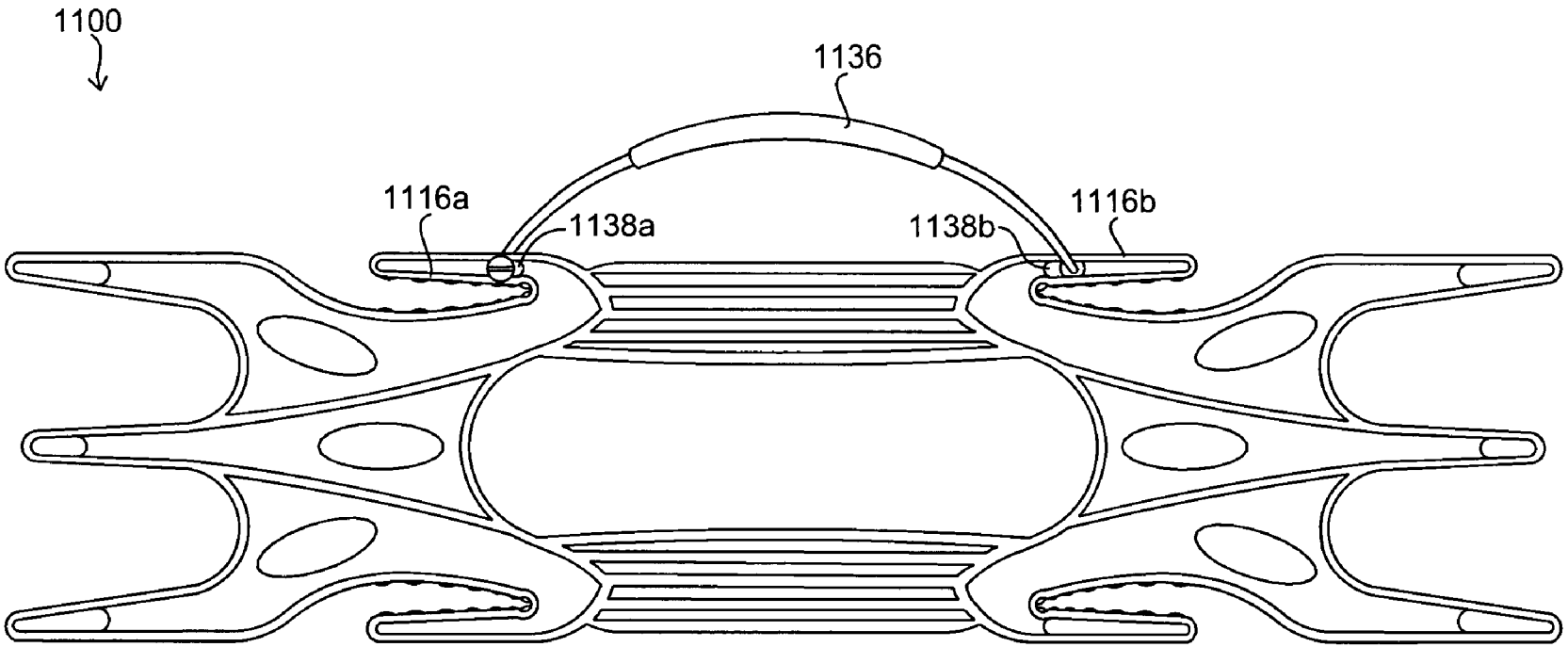
FIG. 11 is a front plan view of an alternative embodiment of a storage unit that includes a different type of removable outer handle.

FIG. 11 is a front plan view of another alternative embodiment of a storage unit 1100. The storage unit 1100 shown in FIG. 11 also includes a removable outer handle 1136. The removable outer handle 1136 shown in FIG. 11 is a molded piece 1136 that is comfortable to the hand when gripped. One end of the molded piece 1136 is inserted through a first hole 1138*a* in the upper left finger 1116*a*. The other end of the molded piece 1136 is inserted through a second hole 1138*b* in the upper right finger 1116*b*.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A storage unit for storing a flexible elongated object, the storage unit having a storage unit length, the storage unit comprising:

a first winding region having a first winding region length, wherein the first winding region length is parallel to the storage unit length;

a second winding region having a second winding region length, wherein the second winding region length is parallel to the storage unit length;

a tapered slot, comprising at least two successive pairs of nubs on opposite walls of the tapered slot, wherein both pairs of nubs are configured to grip a single cord and wherein the successive pairs of nubs progressively decrease in size according to the distance from an open end of the tapered slot; and a post between the first winding region and the second winding region.

2. The storage unit of claim 1, wherein the tapered slot tapers to a point.

3. The storage unit of claim 1, wherein a first winding region inner length is substantially equal to a second winding region inner length.

4. The storage unit of claim 1, wherein the slot is configured to flex.

5. The storage unit of claim 1, wherein the post is removable.

6. The storage unit of claim 1, further comprising an inner handle, wherein a portion of the handle is located within the first winding region.

7. The storage unit of claim 6, wherein the inner handle comprises a plurality of ribs.

8. The storage unit of claim 6, further comprising an outer handle, wherein a portion of the outer handle is located completely outside the first winding region and the second winding region and the second windings region.

9. A device for storing a flexible elongated object, comprising:

a first portion including:

a handle, having a first end and a second end;

a first retaining portion, including:

a tapered slot having an open end, a closed end, an inner, wall and an outer wall, wherein the closed end of the tapered slot is connected to the first end of the handle, and a winding region connected to the inner wall of the tapered slot at the open end of the tapered slot designed to retain a winding of the flexible elongated object;

a second retaining portion connected to the second end of the elongated handle, configured to mirror the first retaining portion; and a second portion connected to the first portion, designed to identically mirror the first portion.

10. The device in claim 9, wherein the handle, tapered slot and winding region are each oriented substantially parallel.

11. The device in claim 10, wherein the winding region has an outer wall that is substantially planar with the outer wall of the tapered slot.

12. The device in claim 11, wherein the tapered slot further comprises a pair of nubs attached to the inner wall and outer wall, configured to act in concert to grip the flexible object.

13. The device in claim 12, further comprising at least two successive pairs of nubs wherein both pairs of nubs are configured to grip, in concert, a single flexible elongated object.

14. The device in claim 13, wherein the successive pairs of nubs progressively decrease in size according to the distance from the open end of the tapered slot.

15. The device in claim 9, further comprising a third retaining portion disposed between the first and the second retaining portions.

16. The device in claim 15, further comprising a fourth retaining portion adjacent to the third retaining portion and disposed between the first and second retaining portions.

17. The device in claim 9, wherein the tapered slot tapers to a point.

18. The device in claim 9, wherein the handle comprises a plurality of ribs.

19. The device in claim 9, further comprising a mounting hole configured to allow the device to be removably attached to a surface.

20. The device of claim 9, further comprising a center post configured to facilitate changing winding direction.

* * * * *